US005757364A

United States Patent [19]

Ozawa et al.

[11] Patent Number: 5,757,364

[45] Date of Patent: May 26, 1998

[54] GRAPHIC DISPLAY APPARATUS AND DISPLAY METHOD THEREOF

[75] Inventors: Koji Ozawa, Hitachiohta; Masahiro Shiraishi; Kazunori Oniki, both of Hitachi, all of Japan

[73] Assignee: Hitachi, Ltd., Tokyo, Japan

[21] Appl. No.: 624,826

[22] Filed: Mar. 27, 1996

[30] Foreign Application Priority Data

Mar. 29, 1995 [JP] Japan ..... 7-071073

[51] Int. Cl.[6] ..... G09G 5/00; G09G 5/14; G06F 12/00

[52] U.S. Cl. ..... 345/201; 345/119; 395/508

[58] Field of Search ..... 345/201, 118, 345/119, 120, 122; 395/508, 509, 173

[56] References Cited

U.S. PATENT DOCUMENTS

| | | | |
|---|---|---|---|
| 4,688,190 | 8/1987 | Bechtolsheim | 345/200 |
| 4,954,819 | 9/1990 | Watkins | 345/119 |
| 5,043,923 | 8/1991 | Joy et al. | 345/119 |
| 5,050,102 | 9/1991 | Sun et al. | 345/122 |
| 5,367,318 | 11/1994 | Beaudin et al. | 345/201 |
| 5,430,838 | 7/1995 | Kuno et al. | 345/119 |
| 5,440,680 | 8/1995 | Ichikawa et al. | 395/509 |
| 5,475,812 | 12/1995 | Corona et al. | 345/120 |
| 5,493,637 | 2/1996 | Martin | 395/122 |
| 5,512,918 | 4/1996 | Forrest et al. | 345/201 |
| 5,543,824 | 8/1996 | Priem et al. | 345/201 |
| 5,587,726 | 12/1996 | Moffat | 345/201 |
| 5,600,346 | 2/1997 | Kamata et al. | 345/120 |

FOREIGN PATENT DOCUMENTS 6-223 196 8/1994 Japan .

*Primary Examiner*—Richard Hjerpe
*Assistant Examiner*—Paul A. Bell
*Attorney, Agent, or Firm*—Kenyon & Kenyon

[57] ABSTRACT

The present invention relates to a graphic display apparatus for a multi-window graphic displaying system comprises a frame memory including double buffers for storing pixel data of display frames, first memorizing means for storing a successive frame number allocated to each pixel in each one of the display frames of which each set of pixel information is successively displayed and renewed, second memorizing means for storing window identifiers, each one of the identifiers being allocated in advance to each one of the multi-windows to be displayed, a table for storing the allocated frame numbers, information of designating one of buffers in the double-buffer and background color information, for each one of the multi-window, and means for comparing each one of the window identifiers and each one of the frame numbers read out from the first and second memorizing means, with each one of the window identifiers and each one of the frame numbers stored in the table, respectively, and for deciding pixel data to be displayed, based on results of the comparison, whereby it is not necessary to clear pixel data of the buffers for storing pixel data in each frame rendering, and the pixel data overwritten on the buffers need not to be cleared until the frame numbers overflow the first memorizing means.

7 Claims, 6 Drawing Sheets

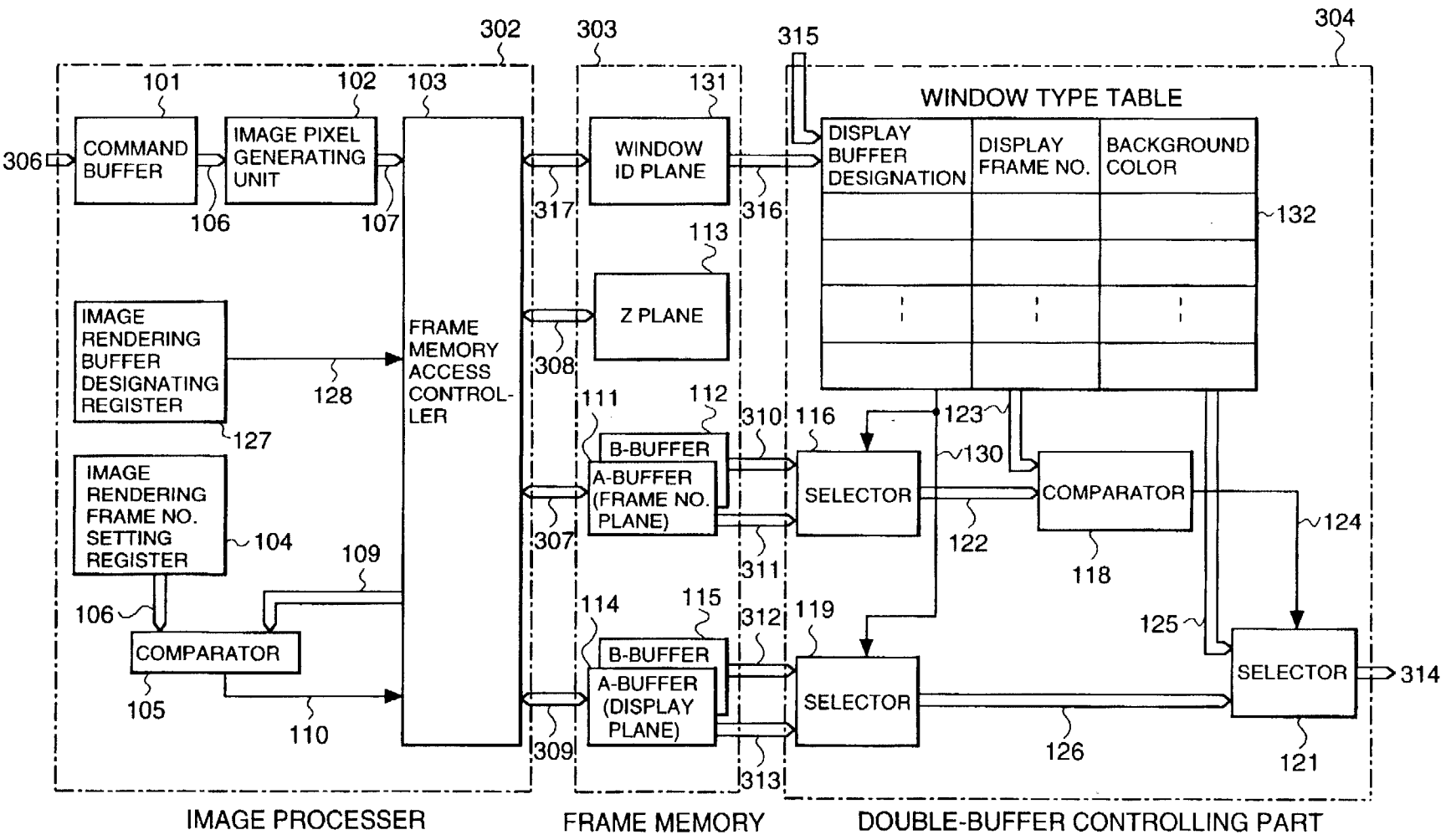
FIG. 1
WINDOW TYPE TABLE
DISPLAY BUFFER DESIGNATION
DISPLAY FRAME NO.
BACKGROUND COLOR
SELECTOR
COMPARATOR
SELECTOR
SELECTOR
DOUBLE-BUFFER CONTROLLING PART
WINDOW ID PLANE
Z PLANE
B-BUFFER
A-BUFFER (FRAME NO. PLANE)
B-BUFFER
A-BUFFER (DISPLAY PLANE)
FRAME MEMORY
FRAME MEMORY ACCESS CONTROL-LER
IMAGE PIXEL GENERATING UNIT
COMMAND BUFFER
IMAGE RENDERING BUFFER DESIGNATING REGISTER
IMAGE RENDERING FRAME NO. SETTING REGISTER
COMPARATOR
IMAGE PROCESSER
304
132
124
314
121
125
118
126
123
130
122
315
316
116
119
310
311
312
313
131
113
112
115
303
111
114
317
308
307
309
302
103
107
102
128
109
110
101
106
127
104
105
306

GRAPHIC DISPLAY APPARATUS AND DISPLAY METHOD THEREOF

BACKGROUND OF THE INVENTION

1. Field of the Invention

The present invention relates to a graphic display apparatus having a frame memory of a double-frame structure, for displaying graphs at high speed.

2. Description of Related Art

The following graphic display method has been devised. That is, in the existing method, a frame memory of a double-frame structure composed of a pair of buffers (for example, referred to A-buffer and B-buffer) is used, and for example, while contents of A-buffer are displayed on a graphic display device, the next graph (or an image) is rendered on B-buffer. Then, after rendering the graph on the B-buffer is finished, contents of the B-buffer are displayed on the graphic display. As mentioned above, by using alternately A-buffer and B-buffer, for rendering a graph on each buffer and for displaying the rendered contents, respectively, dynamic images such as animation can be smoothly displayed.

In an existing method, when the next graph is rendered on the A-buffer, it is necessary to clear the previously rendered contents of the buffer before the next graph is rendered. In the case of cleaning the contents of the A-buffer, a clearing instruction is sent from an application program, and a cleaning command is issued to an image processor 401 shown in FIG. 4. On receiving the cleaning command, the image processor 401 writes the predetermined initialization data on the A-buffer 403 or the B-buffer 404 in a frame memory 402 via a frame memory interface 405. A time required for the buffer clearing depends on the number of pixels to be cleared, the number of data bits prepared for a pixel, a width of the form memory interface 405, the number of image processors, an access time to memories forming the frame memory 402, etc. And, the time required for the buffer cleaning is about in a range from several ms to tens of ms as for an existing three-dimensional graphic work station.

In the case of displaying dynamic images such as animation for real time, an image of one frame has to be rendered for 33 ms, since images of thirty frames must be rendered for 1 S. Since the time required for the buffer clearing is included in the time of 33 ms, if the time required for the buffer cleaning is in the range from several ms to tens ms, a time required for the image rendering becomes short, and then the real time displaying dynamic images may be impossible in some cases.

A method for solving the above-mentioned problem has been proposed in JP-A-223196/1994. This method is aimed at solving the problem by allocating the frame number in an image frame sequence to a region of arbitrary upper bits, referred to a frame number data, of data bits prepared for each pixel data in a Z buffer and/or an image buffer. Explaining in more detail, assuming that the larger Z number an image frame has, the image frame is newer, successive images are rendered in order on the image buffer. And, when an image is newly rendered on the image buffer, the number increased by one is written in each frame number data of a corresponding pixels to the newly rendered image, for the Z buffer and/or the image buffer. Thus, the newly rendered image frame is rendered so as to be disposed upon the previously rendered image frames in the image buffer. With such a method, the rendered contents of each buffer have not to be cleared until the value of the frame number data reaches the maximum number determined by the number of bits prepared for the frame number data.

This existing method, however, is disclosed only for overwriting image frames on an image buffer, and not for processing the image rendering or displaying in a multi-window system in which a plurality of windows are opened on a screen.

SUMMARY OF THE INVENTION

Objects of the Invention

An objective of the present invention is to provide a graphic display apparatus for a multi-window graphic displaying system, being capable of reducing an average time for clearing data of one image frame, even in the case of using fewer image processors, by using a method devised in the present invention which does not require the image clearing after every image frame displaying.

Methods Solving the Problem

The graphic display apparatus for a multi-window graphic displaying system to attain the above-mentioned objective comprises a frame memory including double buffers for storing pixel data of display frames, first memorizing means for storing a successive frame number allocated to each pixel in each one of the display frames of which each set of pixel information is successively displayed and renewed, second memorizing means for storing window identifiers, each one of the identifiers being allocated in advance to each one of the multi-windows to be displayed, a table for storing the allocated frame numbers, information of designating one of buffers in the double-buffer and background color information, for each one of the multi-window, and means for comparing each one of the window identifiers and each one of the frame numbers read out from the first and second memorizing means, with each one of the window identifiers and each one of the frame numbers stored in the table, respectively, and for deciding pixel data to be displayed, based on results of the comparison. Further, in the present invention, each buffer in the double-buffer of the frame memory stores pixel data of a plurality of display frames together, and the frame numbers stored in the first memorizing means are allocated to each pixel position of one of planes memorized in the first memorizing means, one by one corresponding to each position of pixel data in each buffer for one of the display frames of the frame memory. And, the pixel data stored in each buffer in the frame memory are cleared only when the maximum frame number overflows the second memorizing means.

With the present invention, it is not necessary to clear the display frame after each process of rendering an image in a display frame, since on which display frame or window the present pixel data are to be rendered or displayed is easily identified by using the frame number uniquely allocated to each display frame for each window.

BRIEF DESCRIPTION OF THE DRAWINGS

FIG. 1 shows a fundamental constitution of an embodiment including an image processor, a frame memory and a double-buffer controlling part of the present invention.

DETAILED DESCRIPTION OF THE EMBODIMENTS

Figure 2:
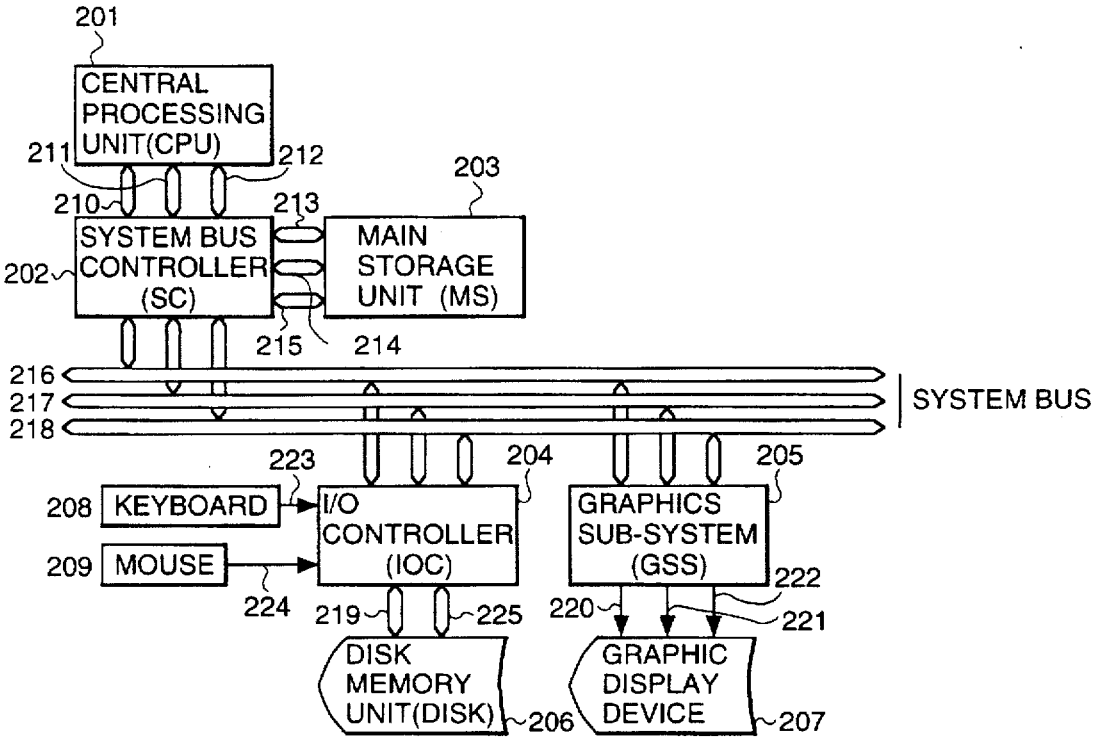
FIG. 2 shows a whole constitution of the embodiment of the present invention.

Hereinafter, details of the present invention will be explained with reference to an embodiment shown in the drawings.

FIG. 2 shows the whole constitution of a system for realizing the present invention. And, the system includes the following components, that is, a central processing unit (CPU) 201, a system bus controller (SC) 202, a main storage unit (MS) 203, an I/O controller (IOC) 204, a graphic subsystem (GSS) 205, a disk memory unit (DISK) 206, a graphic display device (GD) 207, a key board 208 and a mouse 209. Then, those components are connected each other, with address lines 210, 213 and 216, data lines 211, 214, 217 and 225, or control lines 212, 215, 218, 219, 220, 221, 222, 223 and 224.

Programs to be executed by the CPU 201 are stored in the DISK 206, and some ones of the programs in the DISK are loaded on the MS 203, and they are executed by the CPU 201. The CPU 201 transmits graphics commands, graphics data, etc., to the GSS 205, in accordance with the programs. Then, the GSS 205 processes the received graphics commands and display results of the command processing on the GD 207.

Figure 3:
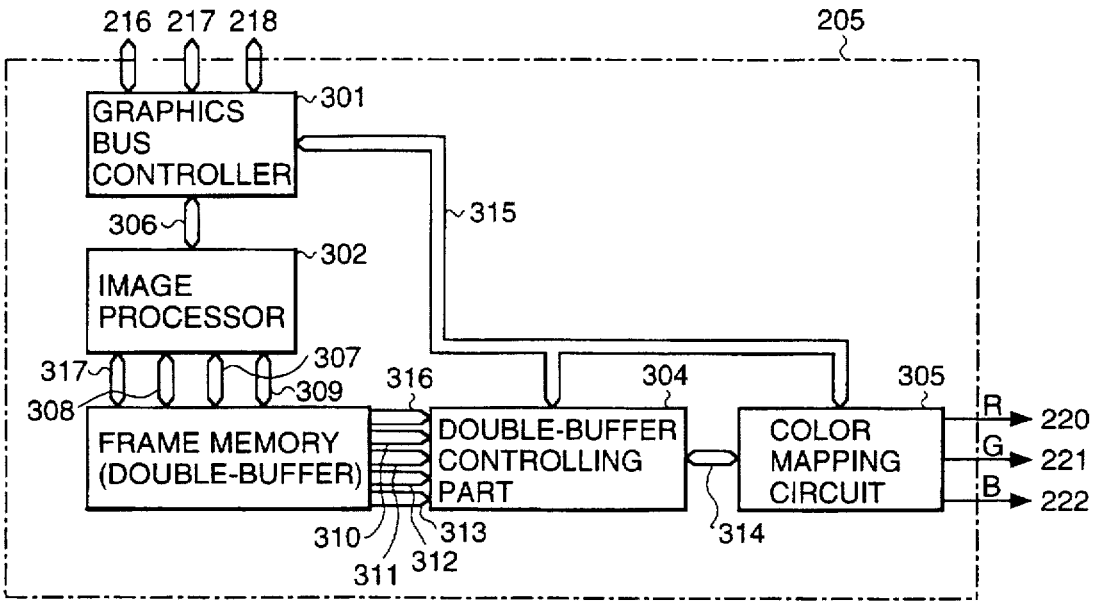
FIG. 3 shows a constitution of a graphics subsystem in the embodiment of the present invention.
Figure 4:
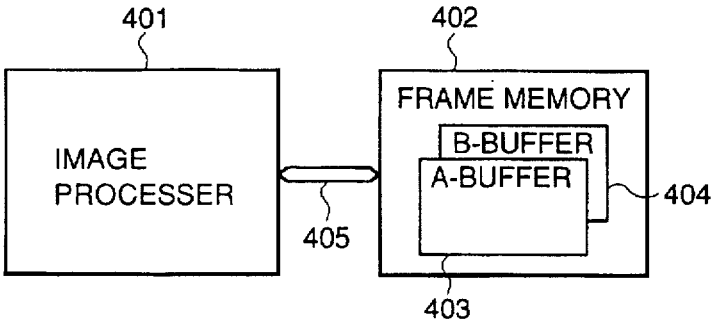
FIG. 4 shows an example of existing techniques.

FIG. 3 shows a constitution of the GSS 205. The data on system buses (216, 217 and 218) such as the graphics commands, the graphics data, etc., are transmitted from the CPU 201 to a graphics bus controller 301, and further to an image processor 302 via an image processor interface 306. The image processor 302 analyzes and executes the received graphics commands and converts them to display information of each pixel. Then, it writes the display information of each pixel, into a frame memory 303 via random ports 307, 308, 309 and 317. A double-buffer controlling part 304 reads out the data stored in a frame memory 303 in order, via serial ports 310, 311, 312, 313 and 316 of the frame memory 303, and after selecting the data read out from the double buffers in the frame memory 303, the double-buffer controlling part 304 transmits the selected data to a color mapping circuit 305 via an interface 314 between the double-buffer controlling part 304 and the color mapping circuit 305. The color mapping circuit 305 has a color look-up table for designating a digital color data of each pixel sent from the frame memory 303 to a corresponding color to be displayed on a screen, and a D/A converter for converting the digital data of the designated color to analog signals of R220, G221 and B222 and for sending the analog signals to the GD 207. Then, the graphics bus controller 301, the double-buffer controlling part 304 and the color mapping circuit 304 are connected each other with an internal bus 315.

Figure 5:
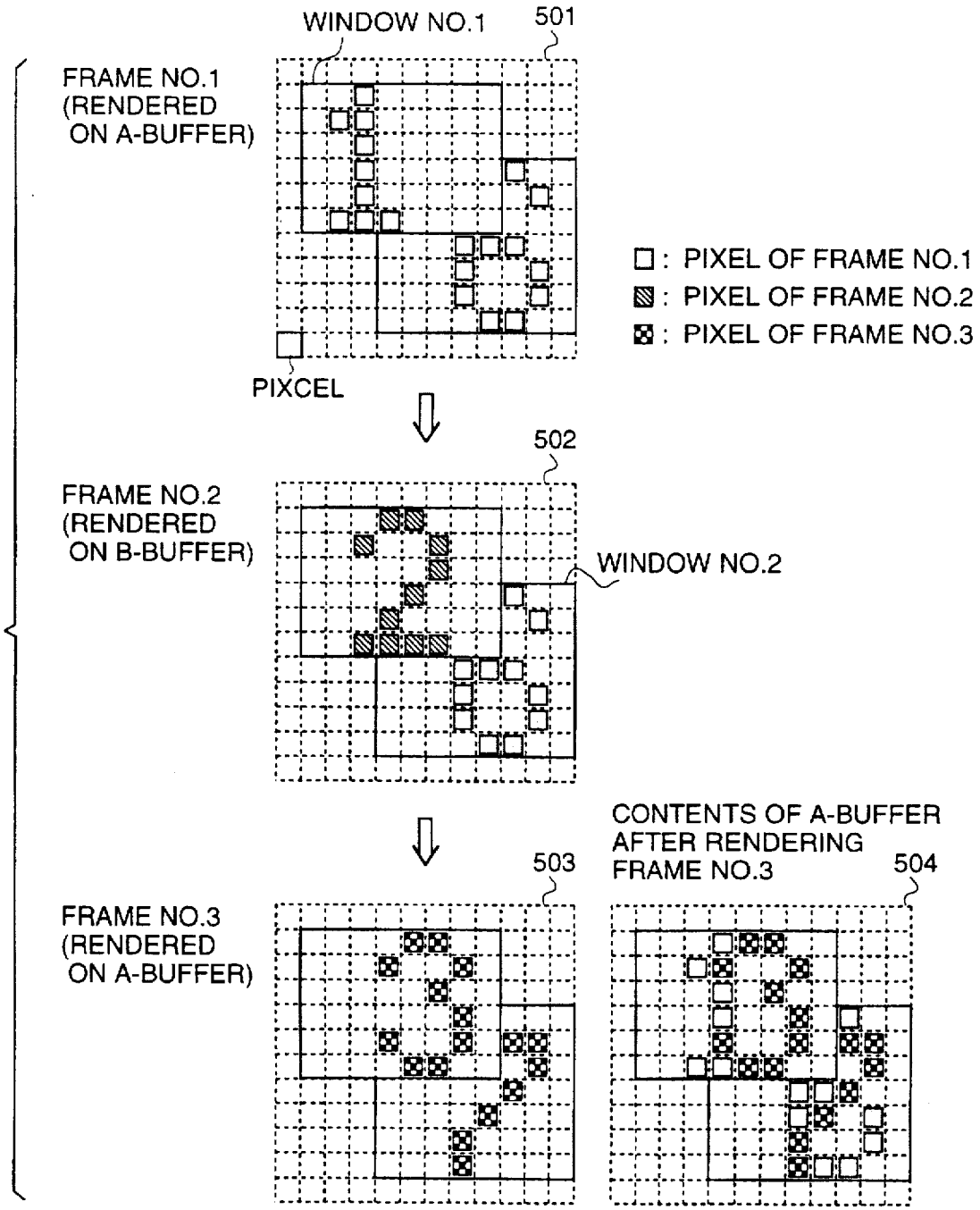
FIG. 5 shows an example of rendering and further overwriting each pixel of each display frame into one of buffers in the embodiment.

With reference to an example of pixel development on each frame shown in FIG. 5, an outline of operations of the embodiment will be explained in the following.

In the example of pixel development on each frame, numeral images "1" and "6" are rendered on a window No. 1 area and a window No. 2 area in the first frame (A-buffer) 501, respectively; a numeral image "2" is rendered on the window No. 1 area and the same numeral image "6" as rendered the previous frame 501 is rendered on the window No. 2 area in the second frame (B-buffer) 502; and numeral images "3" and "7" are rendered on the window No. 1 area and the window No. 2 area in the third frame (A-buffer) 503, respectively. Since the frame memory 303 has a double-buffer structure composed the A and B buffers, the processes of rendering and displaying images are shown as follows.

(1) Render the numeral images "1" and "6" of the first frame 501 into the A-buffer.

(2) Display contents of the A-buffer on a screen, after rendering the numerals into the A-buffer.

(3) Render the numeral images "2" and "6" of the second frame 502 into the B-buffer, while displaying the contents of the A-buffer.

(4) Switch the buffer to be displayed, from the A-buffer to the B-buffer, after rendering the numeral images into the B-buffer.

(5) Render the numeral images "3" and "7" of the third frame 503 into the A-buffer, while displaying the contents of the B-buffer.

(6) Switch the buffer to be displayed, from the B-buffer to the A-buffer, after rendering the numeral images into the A-buffer.

A graphic display apparatus of the embodiment has a constitution of which the main part is shown in FIG. 1, including the image processor 302, the frame memory 302 and the double-buffer controlling part 304.

The successive frame numbers are allocated in order to frames to be successively renewed and displayed. In the image processor 302, an image pixel generating unit 102 analyzes and executes a received image rendering command 306, and then allocates a frame number commonly to pixels of images to be rendered in the same frame. And, the frame number is serially increased in each renewal of a frame to be displayed. The marks allocated to the frames, however, can not be restricted to the number, and any mark distinguishing the frames is available.

Pixel information of each frame to be displayed is stored in the frame memory 303. This frame memory of the embodiment is composed of a Z-plane 113, namely, a Z-buffer for storing display depth information (Z value) of each image, display planes 114 and 115, namely, display buffers explained below, frame No. planes 111 and 112 forming the first memorizing means and a window ID plane 131 as the second memorizing means. The display buffers and the first memorizing means have a double-buffer structure, respectively, in the embodiment. But, even if a single display buffer and the first memorizing means using a single buffer are utilized, the objective of the present invention can be also attained.

The display buffers storing color information (including brightness) of each frame displayed by the GD 207 stores pixel data of each frame to be input to the color mapping circuit 305. And, results of executing the image rendering commands are overwritten on the display buffers until each one of the display buffers receive a pixel data clearing instruction.

Each of the frame No. planes 111 and 112 as the first memorizing means stores the frame numbers allocated to memory regions which have the same number of pixels of a frame to be displayed, each one of the memory regions corresponding one by one to each pixel of each one of the display buffers 114 or 115. Then, the predetermined number of bits are prepared for each one of the memory regions in each frame No. plane, which determines the number of prepared frame No. planes and the pixel data clearing interval of the display buffers. The more bits prepared for the memory region make the clearing interval longer and the speed of image displaying higher.

A window identifier named as a window ID is allocated in advance to each window displayed on a screen. The window ID plane 131 as the second memorizing means stores the window identifiers each of which is allocated to a memory region prepared for each pixel of a frame to be displayed on each window, the each memory region corresponding one by one to each pixel in each one of the display buffers 114 and 115 storing color information of each pixel to be displayed. The number of the bits prepared for each one of the memory regions in the second memorizing means determines the number of windows which can be opened on a screen.

Further, the Z-plane 113 also stores the display depth information allocated to memory regions prepared for each pixel of images of a frame to be displayed on the present window, each one of the memory regions corresponding one by one to each pixel in each one of the display buffers 114 and 115 storing color information of each pixel to be displayed.

The double-buffer controlling part 304 for controlling each buffer of the frame memory 303 of the double-buffer structure includes a window type table 132 which contains the frame number of a frame displayed on each window, a display buffer designation region for storing information on selecting one of the buffers A and B, a frame No. designation region and a background color designation region, for each opened window. The window type table is directly connected to the graphics bus controller 301 via the internal bus 315, and the information stored in the table is renewed with window display information sent in order from the graphics bus controller 301.

And, for each pixel of images displayed on each window, a comparator 118 compares the frame number read out from the first memorizing means with the frame No. stored in the table 312, corresponding to the window identifier sent from the second memorizing means, and a selector 121 decides pixel data to be displayed on the present window based on results of the comparison. Explaining operations of the selector 121 in more detail, the selector 121 extracts pixel data of images to be displayed along with the order of pixels scanned by the GD 207, by comparing the frame number stored in each plane of the frame memory 303 with the frame number stored in the window type table 132 as referring to the window identifier. For a pixel which is not extracted as a pixel of images to be displayed, a background color set in advance in the background color region is selected.

The above-outlined operations of the embodiment is explained in detail in the following with reference to FIGS. 1 and 5.

The image processor 302 sets a designation of A-buffer to an image rendering buffer designating register 127 in order to render image information of the first frame 501 into frame No. planes 111 and a display plane 114 of the A-buffer in the frame memory 303. Then, the image processor 302 adds "1" to content of an image rendering frame No. register 104, since the frame No. of the first frame 501 is 1. And, the CPU 201 issues an image rendering command for rendering images "1" and "6". Then, a command buffer 101 receives the image rendering command and transfers it to the image pixel generating unit 102. The image pixel generating unit 102 processes the image rendering command and obtains data of a pixel position, the window ID, the color information and the display depth information (Z-value), for each pixel of the images, and then transfers the data to a frame memory access controller 103.

Figure 6:
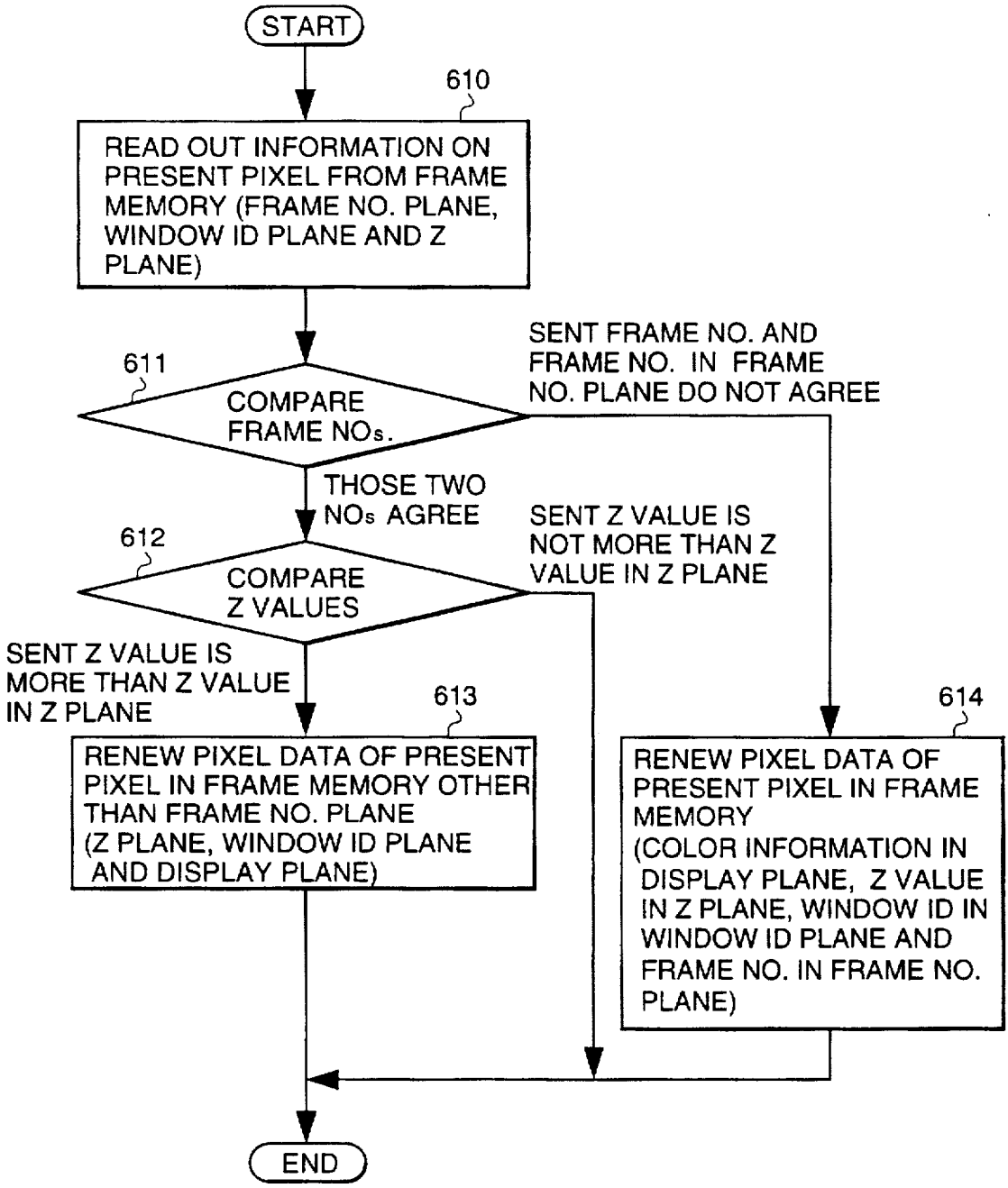
FIG. 6 is a flow chart showing operation processes of a frame memory access controller.

Next, a flow of processing the image rendering command by the image pixel generating unit 102 and storing results of the command processing into the frame memory is shown in FIG. 6. At a step 610, data stored in an address corresponding to the sent position data of each pixel are read out from each one of the Z-planes 113, the frame No. planes 111 and the window ID planes 131. At a step 611, by the comparator 105, the frame No. read out from the frame No. planes 111 is compared with the frame No. presently stored in the image rendering frame No. register 104, and a result 110 of the comparison is input into the frame memory access controller 103. If the result 110 of the comparison indicates "agreement", it means that the pixel data have been already rendered in the present frame, and if the result 110 does not, it means that the pixel data are to be rendered at first in the present frame. Therefore, the frame memory access controller 103 judges that the read out Z value is effective if the result 110 of the comparison indicates "agreement", and compares the Z value sent from the image pixel generating unit 102 with the Z value stored in the Z planes 113, at a step 612. Then, at a step 613, in accordance with the result of the Z value comparison, for example, if a frame on which the pixel is rendered is to be disposed in the most upper position of the present display frame, the color information of the pixel is stored in the position corresponding to the pixel of the display plane 114, and the Z value of the Z planes 113 are renewed. On the other hand, if the result 110 does not indicates "agreement", the read out Z value is not effective since the pixel data is renewed in the present frame, and the Z value comparison is not executed. Then, at a step 614, the color information of the pixel, the Z value and the window ID are written into the display plane 114, the Z planes 113 and the window ID planes 131, respectively. Further, the value in the image rendering frame No. register 104 is written into the frame No. planes 111. By repeating the above-explained pixel data processing for the data sent from the image pixel generating unit 102, for all pixels of the first frame 501, the image rendering of the first frame 501 is finished. The image rendering of other frames is similarly carried out. Now then, since the display contents of the window No. 2 are the same for the first and second frames, the frame No. of the window No. 2 is not renewed in the image rendering for the second frame.

In the following, the process of displaying the frame 501 is explained. The frame No. of a frame which is displayed on each widow in the first frame is stored in the display frame No. region of the window type table 132, in which pixel information of a frame for each window is set. Since pixel information of images rendered in the first frame is stored in the planes 111 and 114 of the A-buffer, the A-buffer is designated in the display buffer designation region of the table 132. Further, color information of a background color for each window is set to the background color designation region of the table 132.

Figure 7:
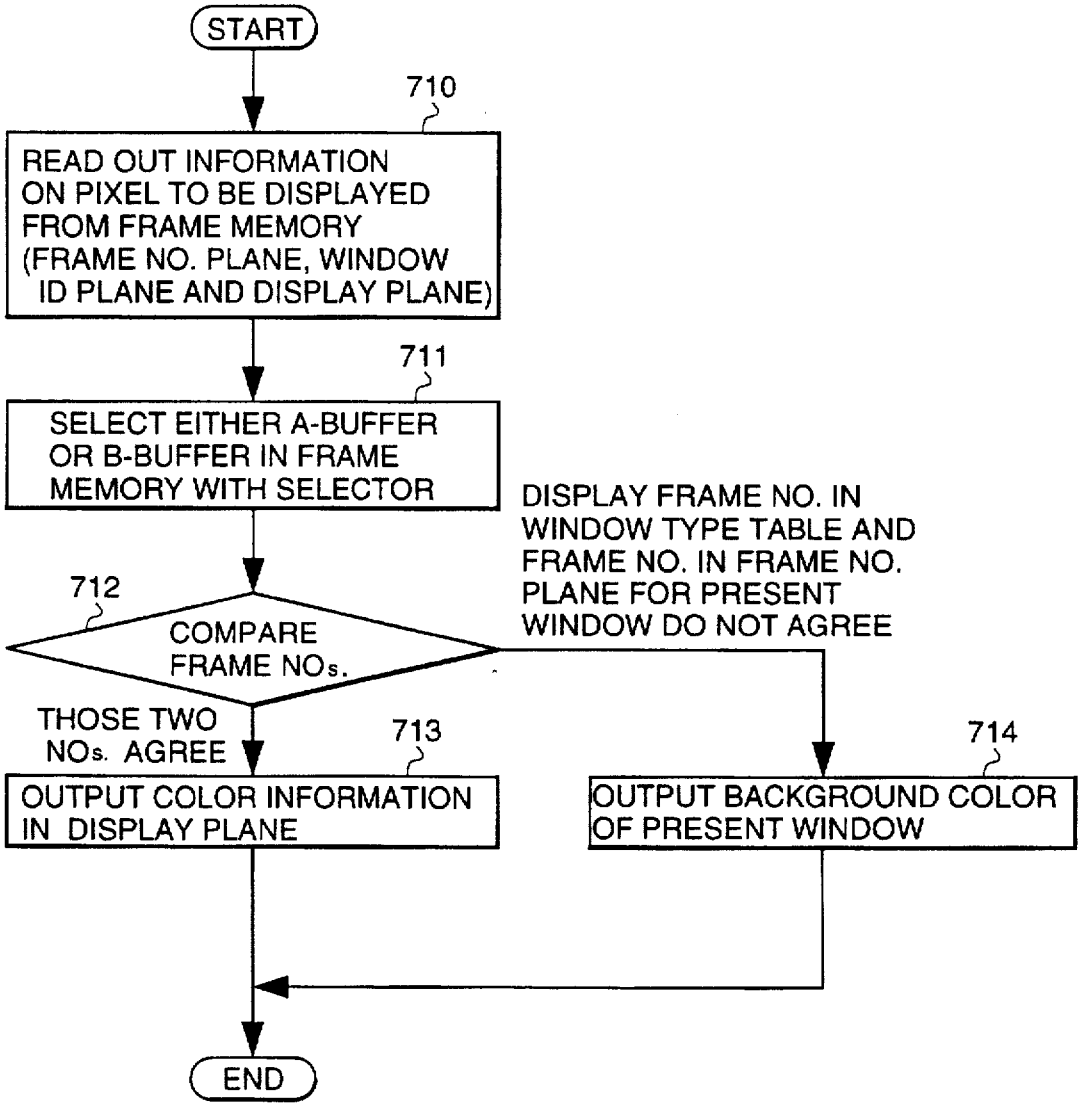
FIG. 7 is a flow chart showing operation processes of a double-buffer controlling part.

And, processing carried out in the double-buffer controlling part 304 is explained below, referring to FIG. 7.

After setting the data to the window type table 132, the display buffer is switched from the B-buffer to the A-buffer, and then the double-buffer controlling part 304 reads out contents of the frame memory 303 in order along with the order of pixels displayed by the GD 207 at a step 710. Although data are read out both A and B-buffers, outputs of the buffer designated in the display buffer designation region of the window type table 132, corresponding to the window ID of the window in which the present pixel is displayed, are selected by selectors 116 and 119, at a step 711. Now then, assuming that the A-buffer is designated in the display buffer designation region, output 122 of the selector 116 is the frame No. stored in the planes 111 of the A-buffer, and outputs of the selector 119 are pixel display data (color information) stored in the plane 114 of the A-buffer. At a step 712, the output 122 of the selector 116 is compared with the value of the display frame No. region. Since the value of the display frame No. region is the frame No. of a frame to be displayed on the present window, if a result 124 of the comparison executed by the selector 118 indicates "agreement", it is permitted to display the present pixel data, otherwise displaying the present pixel data is not permitted. Therefore, at a step 714, if the result 124 of the comparison indicates if "agreement", the selector 121 selects the output 126 of the display plane 114, otherwise the selector 121 selects a background color information 125 designated in the window type table 132, in order to display a background color. Then, the selected background color information 125 is transferred to the color mapping circuit 305 via an interface 314 for the color mapping circuit 305. Thus, the data of a pixel of which the read out frame No. and the frame No. set in the display frame No. region agree is displayed, and a set background color is displayed for two pixel of which those two frame No. do not agree.

As explained above, although the contents 504 of the display plane of the A-buffer contains information mixed with the image information of the present frame and the image information of the previous frames after rendering images into the second frame 502 and the third frame 503 by controlling each frame No., it is possible to display only the present frame by utilizing the frame No. stored in the frame No. planes. Thus, in case eight planes are prepared for the frame No. planes, that is, an eight bits memory region is equivalently prepared for each pixel for allocating the frame No. to each display frame, 256 frames can be overwritten on the display plane of the frame memory, and the newest display frame can be always extracted from the remaining display frames. Therefore, clearing the contents of the display plane has not to be carried out in each frame rendering, but only once per 256 times of frame rendering. Then, the average frame clearing time for a frame is about 1/256 of a time necessary for clearing a frame.

As mentioned above, by adopting the present invention, since it is not necessary to clear a display frame in each frame rendering, the average frame clearing time for a frame can be considerably reduced without increasing the number of image processors, which can realize a high-speed graphic display apparatus for a multi-window display system.

What is claimed is:

1. Graphic display apparatus for a multi-window graphic displaying system, comprising:

a frame memory including double buffers for storing pixel data of display frames;

first memorizing means for storing a successive frame number allocated commonly to pixels in each one of said display frames of which each set of pixel information is successively displayed and renewed;

second memorizing means for storing window identifiers, each one of said window identifiers being allocated in advance to each one of multi-windows to be displayed;

a table for storing said allocated frame numbers, information on designating one of said double buffers and background color information, for each one of said multi-windows; and means for comparing each one of said window identifiers and each one of said frame numbers read out from said first and second memorizing means, with each one of said window identifiers and each one of said frame numbers stored in said table, respectively, and for deciding pixel data to be displayed, based on results of said comparisons.

2. Graphic display apparatus according to claim 1, wherein each one of memory regions storing said frame number for each pixel, prepared in said first memorizing means, corresponds one by one to each pixel of which display information is stored in each one of said double buffers of said frame memory, for storing said display frames.

3. Graphic display apparatus according to claim 1, wherein each one of memory regions storing said window identifier for each pixel, prepared in said second memorizing means, corresponds one by one to each pixel of which display information is stored in each one of said double buffers of said frame memory, for storing said display frames.

4. Graphic display apparatus according to claim 1, wherein pixel data for a plurality of display frames are overwritten on each pixel of said double buffers for storing said display frames, means for registering said frame number of a present one of said display frames to be displayed is provided, and if said registered frame number overflows each one of said registering means, then contents of each one of said double buffers are cleared.

5. Graphic display method for a multi-window graphic displaying system, comprising the steps of:

storing pixel data of display frames into a frame memory including double buffers;

storing a successive frame number allocated commonly to pixels in each one of said display frames of which each set of pixel information is successively displayed and renewed, into first memorizing means;

storing window identifiers, each one of said window identifiers being allocated in advance to each one of multi-windows to be displayed, into second memorizing means;

storing said allocated frame numbers, information on designating one of said double buffers and background color information, for each one of said multi-windows, into a table;

comparing each one of said window identifiers and each one of said frame numbers read out from said first and second memorizing means, with each one of said window identifiers and each one of said frame numbers stored in said table, respectively; and deciding pixel data to be displayed, based on results of said comparisons.

6. Graphic display method according to claim 5, wherein said frame number for each pixel is stored into each one of memory regions prepared in said first memorizing means, said each memory region corresponding one by one to each pixel of which display information is stored in each one of said double buffers of said frame memory, for storing said display frames.

7. Graphic display method according to claim 5, wherein said window identifier for each pixel is stored into each one of memory regions, prepared in said second memorizing means, said each memory region corresponding one by one to each pixel of which display information is stored in each one of said double buffers of said frame memory, for storing said display frames.

* * * * *